US005946918A

United States Patent [19]

Greene

[11] Patent Number: 5,946,918

[45] Date of Patent: Sep. 7, 1999

[54] COOLING OF STORED WATER

[75] Inventor: Ralph G. Greene, Dalton, Ga.

[73] Assignee: Mutual of Omaha Insurance Company, Omaha, Nebr.

[21] Appl. No.: 09/085,672

[22] Filed: May 27, 1998

[51] Int. Cl.[6] ..... F25B 21/02; B67D 5/62

[52] U.S. Cl. ..... 62/3.64; 62/393

[58] Field of Search ..... 62/3.64, 3.2, 3.6, 62/393, 389

[56] References Cited

U.S. PATENT DOCUMENTS

| | | | |
|---|---|---|---|
| 5,314,586 | 5/1994 | Chen | 202/177 |
| 5,535,600 | 7/1996 | Mills | 62/390 |
| 5,544,489 | 8/1996 | Moren | 62/3.64 |
| 5,617,736 | 4/1997 | Ito et al. | 62/393 |
| 5,619,856 | 4/1997 | Lee | 62/3.64 |
| 5,699,669 | 12/1997 | Gebhard | 62/3.64 |

*Primary Examiner*—William Doerrler
*Attorney, Agent, or Firm*—Merchant & Gould P.C.

[57] ABSTRACT

A chilling chamber connected to a water tank or a reservoir which may be within a water purifier or to a pipe within which water flows has a thermally conductive probe which is connected to the cold side of a thermoelectric device, the hot side being connected to a heat sink. A tube is coiled about the probe and has one end connected with the water in the storage reservoir or pipe and another end connected to a faucet. A liquid heat transfer medium such as water is stored within the chilling chamber about the probe and the coil of tubing. The probe cools the heat transfer medium which cools the water within the coil of tubing. Cold water thus flows out the faucet when the faucet is opened for a short time and the water within the coil gradually raises in temperature to again be cooled by the heat transfer medium.

11 Claims, 2 Drawing Sheets

COOLING OF STORED WATER

BACKGROUND OF THE INVENTION

This invention relates to the cooling of water stored in a reservoir as the water is dispensed and more particularly to a cooling chamber for use with a room temperature water storage reservoir from which cooled water is to be dispensed and cooled.

A conventional chiller or cooler used for dispensing liquids such as a cooler/dispenser used for bottled water utilizes refrigeration equipment including a compressor unless the liquid is within a reservoir surrounded by ice or a refrigerant or other heat transfer medium. Examples, of the latter are illustrated in Pique U.S. Pat. No. 2,506,840; Olson U.S. Pat. No. 2,821,844; Geisler U.S. Pat. No. 3,270,520 and Bonimi U.S. Pat. No. 4,238,053; while examples of the former are illustrated in Natter U.S. Pat. No. 3,462,970 and Schroeder U.S. Pat. No. 3,892,335; while Radino U.S. Pat. No. 5,079,927 illustrates a hybrid combination of these. In Moren U.S. Pat. No. 5,544,489 there is disclosed a thermoelectric device having a probe that extends into water within a receptacle to cool the liquid, the thermoelectric device being one which responds to a direct current input to provide one side relatively cooled and one side relatively heated.

One problem that has been recognized with combination chiller-dispensers having a water storage reservoir is that the stored water may easily be contaminated with air-borne bacterial. It has been found that a substantial percentage of such units have bacteria levels above that permitted by governmental regulation. In such storage reservoirs and also in the bottled water used with chilling dispensers air must enter and displace the water to permit the water to exit. Thus, even with apparatus that purifies water, such as that disclosed in Greene et al U.S. Pat. No. 5,662,779, when the water is disposed through a cooling dispenser, the water may become contaminated when the water is dispensed. As the air enters so does bacteria, mold and viruses carried by the air. These organisms may grow and multiply in the stored water resulting in potential sources of disease. If the water bottle or storage tank into which the air may enter could be eliminated, the growth of bacteria from air-borne sources may be greatly reduced.

SUMMARY OF THE INVENTION

Consequently, it is a primary object of the present invention to provide a chiller from which water may be dispensed without the water being stored in the chiller so as to minimize the potential for air-borne bacteria entering the water.

It is another object of the present invention to provide a chilling chamber having an inlet water tube fed from a source of water at room temperature, the inlet water tube communicating with tubing coiled about a thermoelectric cooling probe disposed within the chilling chamber, the tubing further communicating with a faucet to dispense water from the coil selectively.

It is a further object of the present invention to provide a chilling chamber having an inlet water tube fed from a source of water at room temperature, the inlet water tube communicating with tubing coiled about a thermoelectrically cooled probe disposed within the cooling chamber, water or other heat transfer medium being disposed within the cooling chamber surrounding the probe and coil so that the probe chills the heat transfer medium which cools the water within the coil.

Accordingly, the present invention provides a chilling chamber separate from a room temperature supply or storage reservoir into which a thermally conductive probe extends, the probe being connected to the cold side of a thermoelectric device having its hot side connected to a heat sink outside the chamber. The chilling chamber has an inlet tube communicating with the water supply and with tubing coiled about the probe and communicating with an outlet valve, the chilling chamber having a heat transfer medium therein which is chilled by the probe and absorbs heat from the water within the coil to cool the water. The water that is dispensed through the outlet valve flows continuously so that air does not displace the water. Thus, air-borne bacteria and other contaminants do not enter the water supply or storage reservoir. Additionally, since the cooling is effected from the probe to the heat transfer medium within the chilling chamber and not directly from the probe to the water being dispensed, as in aforesaid U.S. Pat. No. 5,544,489, water that has been purified by distillation, as in the aforesaid Greene et al U.S. Pat. No. 5,662,779, or by reversed osmosis, and thus is low in dissolved solids, is not affected by the inefficiencies associated with direct transfer of heat from such pure water. Generally, water low in impurities does not transfer heat as readily as water high in such impurities.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
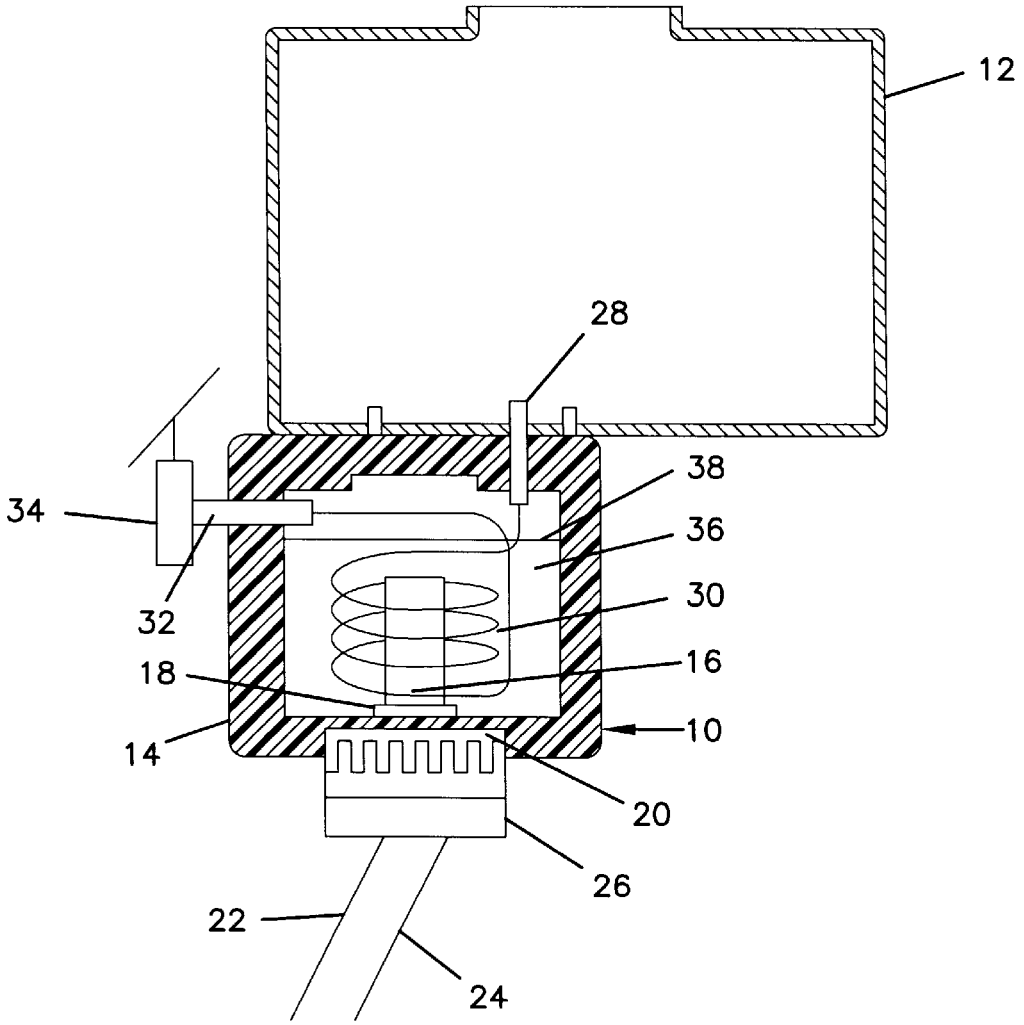
FIG. 1 is a diagrammatic elevational view partly in section illustrating a chilling chamber constructed in accordance with the principles of the present invention in combination with a water reservoir.

Referring to the drawings, FIG. 1 illustrates a chilling or cooling chamber 10 constructed in accordance with the present invention operatively connected to a water storage tank 12, which tank may be the storage reservoir of a water purifier such as that in Greene et al U.S. Pat. No. 5,662,779, containing water at room temperature. The chilling chamber 10 is a reservoir or housing having a thermally insulated wall structure 14. Extending through a hole in the wall is a thermally conductive probe 16 which in accordance with the disclosure in the aforesaid U.S. Pat. No. 5,544,489 is connected through a conductive base (not illustrated) portion of the probe to a thermoelectric device 18 which in turn is connected to a heat sink 20. The thermoelectric device 18 is a commercially available device producing a reduced temperature on one side and a raised temperature on the other side when a d.c. voltage is applied by conductors 22, 24 across the device. In regard to the present invention, the cold side faces the interior of the chilling chamber 10 and the hot side faces the heat sink 20. The probe 16, is cooled by conduction of the cold side of the thermoelectric device 18 through the base of the probe. A fan 26 may act to blow air to withdraw heat from the heat sink 20 as in the aforesaid U.S. Pat. No. 5,554,489, the disclosure therein being incorporated herein by reference.

Connected in flow communication with the storage tank 12 is an inlet tube or first end 28 of a coil of tubing 30. The tubing 30 is coiled about the probe 16 substantially in helical fashion and has the outlet or second end 32 connected through a wall of the chilling chamber in flow communication with a valve or faucet 34 so that when the faucet is open water may flow from the tank 12 through the coil 30 and out the faucet. The faucet may be any device which permits the water to flow selectively through the tubing, and may be designated a spigot, stopcock or petcock. Additionally located within the chilling chamber 10 is a liquid heat transfer medium 36 which may be water or a thermally enhanced cooling solution, the level 38 of the medium 36 being above the top of the probe 16 and preferably also the coil 30.

With such a construction, the heat transfer medium 36 becomes supercooled around the probe 16. If the medium 36 is water an iceball forms around the probe and gradually enlarges until it reaches equilibrium which is determined by the cooling liquid volume, its composition and the amount of insulation of the chamber. If the chilling chamber is small, sealed and well insulated, the iceball will form quicker. Having the liquid chilled as it flows through a thermally conductive tube, as opposed to the direct cooling approach in the aforesaid U.S. Pat. No. 5,544,489, allows the size of the chilling chamber to be relatively small. To form ice, the thermoelectric device must first cool the liquid in the cooling chamber down to near freezing temperature, then ice will slowly form layer by layer around the outside of the chilling probe. The forming of ice will occur much faster if the volume of liquid that must be chilled is small. Freezing of the water within the coil is prevented by sizing the coil diameter, the insulation and the heat transfer medium to the inherent temperature regulation of the stored cooling energy. It may be noted that the liquid temperature surrounding the ice that is formed is approximately 39 degrees F. which is much colder than required. Directing the liquid to be cooled through a thermally conductive tube slows the transfer of cooling effects and raises the temperature of the dispensed liquid gradually as the liquid is dispensed. The first few cups or glasses of water out of the cooling tube will thus be substantially as cold as the liquid in the chilling reservoir. After a couple of cups or glasses are dispensed, the temperature of the dispensed liquid will rise gradually. If there is a period of time that passes between dispensed cups or glasses of water, the temperature will again lower to approximately that of the liquid temperature of the chilled water in the chilling reservoir.

The length of the tubing 30, its diameter and material are selected to control the temperature of the room temperature water in the reservoir 12 as it is dispensed from the chilling chamber 10. As aforesaid, the output temperature of the dispensed water for the first cup or two is substantially equal to or a few degrees above the temperature of the chilled water reservoir. As more water is dispensed, the temperature of the dispensed water gradually increases, but if a minute or more is allowed between dispensing of a cup or glass of water, the temperature will decrease accordingly.

Figure 2:
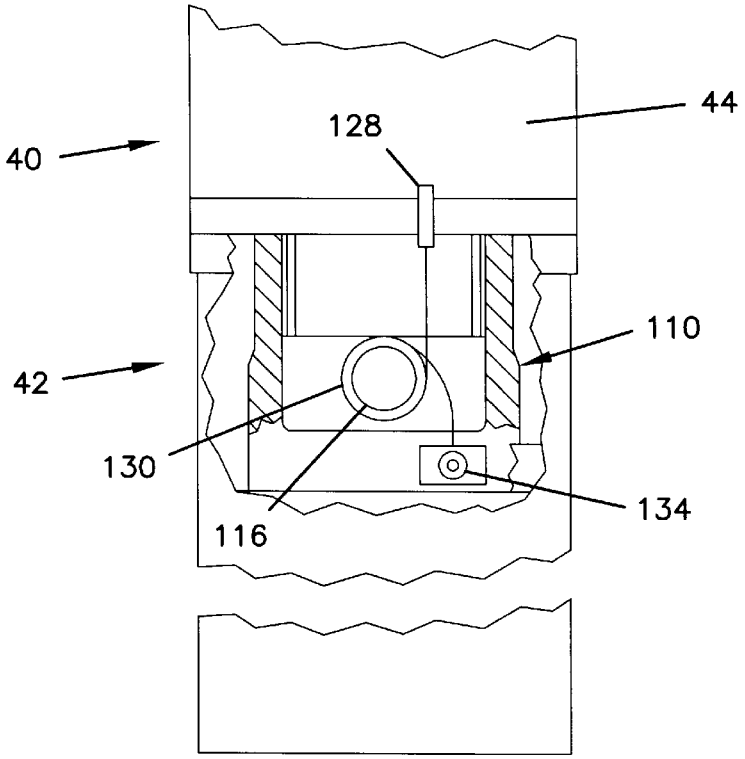
FIG. 2 is a fragmentary diagrammatic elevational view with parts thereof broken away and in section illustrating a portion of a water purifier mounted on a water cooling dispenser incorporating a chilling chamber in accordance with the present invention.

As aforesaid, the cooling system may be used in conjunction with a water purifying system as in Greene et al U.S. Pat. No. 5,662,779. Thus, as illustrated in FIG. 2, a water purifier 40 is positioned on dispensing apparatus 42, a chilling chamber 110 similar to the chamber 10 being disposed in the upper portion of the dispenser intermediate the reservoir 44 of the purifier and the dispenser outlet valve 134. The probe 116 here is illustrated as being disposed with its axis horizontal, but this may be chosen or dictated according to space limitations. The coil 130 is thus illustrated as coiled about the horizontal axis with the intake tube 128 extending into the reservoir 44. The level of the heat transfer medium being above the probe and the coils of the tubing.

Figure 3:
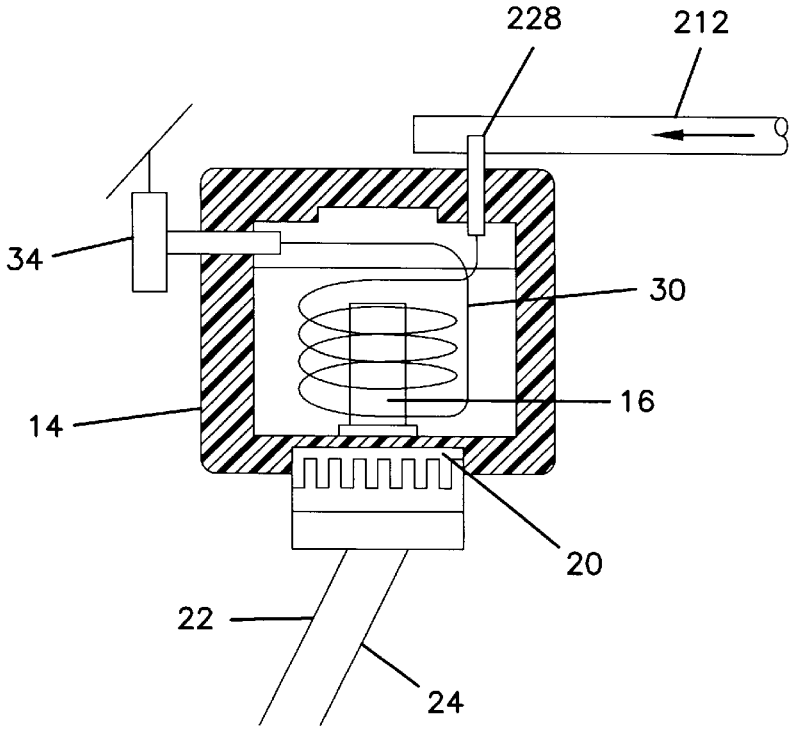
FIG. 3 is a diagrammatic view of a water cooling dispenser in accordance with the present invention connected to conventional water supply piping.

To illustrate the versatility of the chilling system, FIG. 3 depicts in-line cooling using the chilling system of the present invention, i.e., its adaptability to water supply piping. Here, the inlet tube 228 extends into the supply pipe 212 rather than into a reservoir. Thus a storage reservoir and level control means are eliminated when used with a filter system. In all other respects the system may be identical to that illustrated in FIG. 1.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. Apparatus for chilling and dispensing water received from a water supply, comprising a chilling chamber, a thermally conductive probe disposed within said chamber, said probe having a base end and a tip end, a thermoelectric device operable for producing a first surface having a relatively cold temperature and a second surface having a relatively hot temperature, said first surface being in heat conducting contact with said base end of said probe, a heat sink disposed outside said chamber, said second surface being in heat conducting contact with said heat sink whereby said probe may be cooled and heat energy therein transferred to said heat sink and dispersed to ambient environment outside said chamber, a coil of tubing disposed about said probe, said coil of tubing having a first end and a second end, said first end and said second end are disposed above said tip end of said probe, an inlet member operatively connecting said first end in flow communication with said water supply, outlet valve means operatively connected in flow communication to said second end of said coil for dispensing water selectively from said tubing, and a liquid heat transfer medium within said chamber surrounding said probe and at least a substantial portion of said coil of tubing for transferring heat from the water within said coil to said probe.

2. Apparatus as recited in claim 1, wherein said liquid heat transfer medium comprises water.

3. A water chilling and dispensing system, comprising:

a water storage reservoir defined by a plurality of walls;

a chilling chamber mounted to at least one of said plurality of walls of said water storage reservoir, a thermally conductive probe disposed within said chamber, a thermoelectric device operable for producing a first surface having a relatively cold temperature and a second surface having a relatively hot temperature, said first surface being in heat conducting contact with said probe, a heat sink disposed outside said chamber, said second surface being in heat conducting contact with said heat sink whereby said probe may be cooled and heat energy therein transferred to said heat sink and dispersed to ambient environment outside said chamber, a coil of tubing disposed about said probe, said coil of tubing having a first end and a second end, an inlet member operatively connecting an interior of said water storage reservoir with said first end, outlet valve means operatively connected in flow communication to said second end of said coil for controlling flow through said tubing, and a liquid heat transfer medium within said chamber surrounding said probe and at least a substantial portion of said coil of tubing.

4. A system as recited in claim 3, wherein said liquid heat transfer medium comprises water.

5. A system as recited in claim 3, wherein said water storage reservoir is within a water purification apparatus.

6. A system as recited in claim 5, wherein said liquid heat transfer medium comprises water.

7. Apparatus as recited in claim 1, wherein said chilling chamber is defined by a thermally insulated wall structure.

8. Apparatus as recited in claim 1, wherein the water supply is a water storage reservoir.

9. Apparatus as recited in claim 1, wherein the water supply is a water supply pipe.

10. Apparatus as recited in claim 1, wherein said probe extends through substantially the entire length of said coil of tubing.

11. A system as recited in claim 3, wherein said chilling chamber is defined by a thermally insulated wall structure.

* * * * *